United States Patent [19]

Hummel et al.

[11] Patent Number: 4,960,053

[45] Date of Patent: Oct. 2, 1990

[54] VIBRATOR CONTROL FOR INKING UNITS OF PRINTING PRESSES

[75] Inventors: Peter Hummel, Offenbach am Main; Roland Höll, Weiterstadt, both of Fed. Rep. of Germany

[73] Assignee: Man Roland Druckmaschinen AG, Fed. Rep. of Germany

[21] Appl. No.: 427,584

[22] Filed: Oct. 26, 1989

[30] Foreign Application Priority Data

Oct. 27, 1988 [DE] Fed. Rep. of Germany ..... 3836580

[51] Int. Cl.[5] ..... B41F 31/14; B41F 31/30

[52] U.S. Cl. ..... 101/350; 101/352

[58] Field of Search ..... 101/348, 349, 350, 351, 101/352, 145, 218

[56] References Cited

U.S. PATENT DOCUMENTS 4,466,347 8/1984 Difflipp et al. ..... 101/350

FOREIGN PATENT DOCUMENTS 1248682 8/1967 Fed. Rep. of Germany .
2105622 9/1971 Fed. Rep. of Germany .
2105622 9/1971 Fed. Rep. of Germany .

OTHER PUBLICATIONS

IMB Technical Disclosure Bulletin, vol. 17, No. 7, Dec. 1974, C. Holovka, Jr.

*Primary Examiner*—Clifford D. Crowder
*Assistant Examiner*—Ren Yan
*Attorney, Agent, or Firm*—Leydig, Voit & Mayer

[57] ABSTRACT

A vibrator control is arranged to produce a brief pause or interruption in the movement of a vibrator roller before the vibrator alternately engages with an ink ductor and with a distributing roller wherein the arms of a pair of rocking levers which journal the vibrator roller at both ends are each operatively connected to an oscillating forked lever on alternate sides by means of opposed adjusting screws which cause the rocking levers to bear against one of two resilient abutments disposed opposite one another on the press frame. The adjusting acrews are adjusted so that a gap is alternatiely created between each of them and the rocking lever as the forked lever moves to the center of its oscillating stroke.

2 Claims, 2 Drawing Sheets

VIBRATOR CONTROL FOR INKING UNITS OF PRINTING PRESSES

FIELD OF THE INVENTION

The present invention relates generally to a vibrator control for inking units of printing presses, and more particularly concerns such a control for both reducing impacts and automatically compensating for wear.

BACKGROUND OF THE INVENTION

A prior art type of vi control for inking units is known from DE-AS 1,248,682. As disclosed in this reference, a forked lever is connected to a link and the link is connected to the cam follower lever such that the place of articulation is adjustable. This construction facilitates accurate distance (stroke) adjustment of the vibrator. However, substantial impacts also occur in operation at the critical point in the oscillating movement of the vibrator—i.e., when the vibrator engages with and disengages from the ink ductor and the distributing rollers. Another disadvantage is that as vibrator diameter varies, for example, because of wear, the times of engagement and, therefore, the widths of the vibrator-transferred ink strips vary.

It is also known from DE-OS 2,105,622 to adjust the engagement of the vibrator with the ink ductor and with the distributing roller by adjustable abutments. In this arrangement, since the abutments, which are rigidly disposed on the press, cooperate with rubber blocks on a rocking lever, a resilient engagement with adjustment is possible but there can be no pause in vibrator movement before it engages with either of the other rolls. Therefore, the disadvantages described above also occur in this case—i.e., the vibrator strikes the ductor too fast and the engagement times and thus the width of the ink strips vary because of wear.

OBJECTS AND SUMMARY OF THE INVENTION

It is therefore the primary aim of the present invention to provide an improved vibrator control of the kind specified so that a brief interruption of vibrator movement, in the form of a pause in such movement, can be arranged before the vibrator alternately engages with the ink ductor and the distributing roller along their respective lines of engagement (P and P').

In accordance with the present invention, a vibrator control is arranged to produce a brief pause or interruption in the movement of a vibrator roller before the vibrator alternately engages with an ink ductor and with a distributing roller wherein the arms of a pair of rocking levers which journal the vibrator roller at both ends are each operatively connected to an oscillating forked lever on alternate sides by means of opposed adjusting screws which cause the rocking levers to bear against one of two resilient abutments disposed opposite one another on the press frame. The adjusting screws are adjusted so that a gap is alternately created between each of them and the rocking lever as the forked lever moves to the center of its oscillating stroke.

The invention has a number of advantages over the prior art. The pause in the movement compensates for any inaccuracies in vibrator control. The result is constant parallel vibrator ink strips and constant minimal speeds of impact of the vibrator on the ductor and on the distributing roller despite variations in the diameters of the latter three elements. The ink strips can be reproduced exactly from printing unit to printing unit since a readjustment occurs automatically when the vibrator is adjusted relatively to the ductor and to the distributing roller. Consequently, diameter variations of approximately ±1.5 mm of the vibrator and minor diameter differences of the ductor and of the distributing roller do not impair the set-up operating conditions—i.e., the engagement of the vibrator along the lines of contact P or P'—nor is the reproducibility of the set-up vibrator ink strips (engagement time) impaired.

These and other features and advantages of the invention will be more readily apparent upon reading the following description of a preferred exemplified embodiment of the invention and upon reference to the accompanying drawings wherein:

Figure 1:
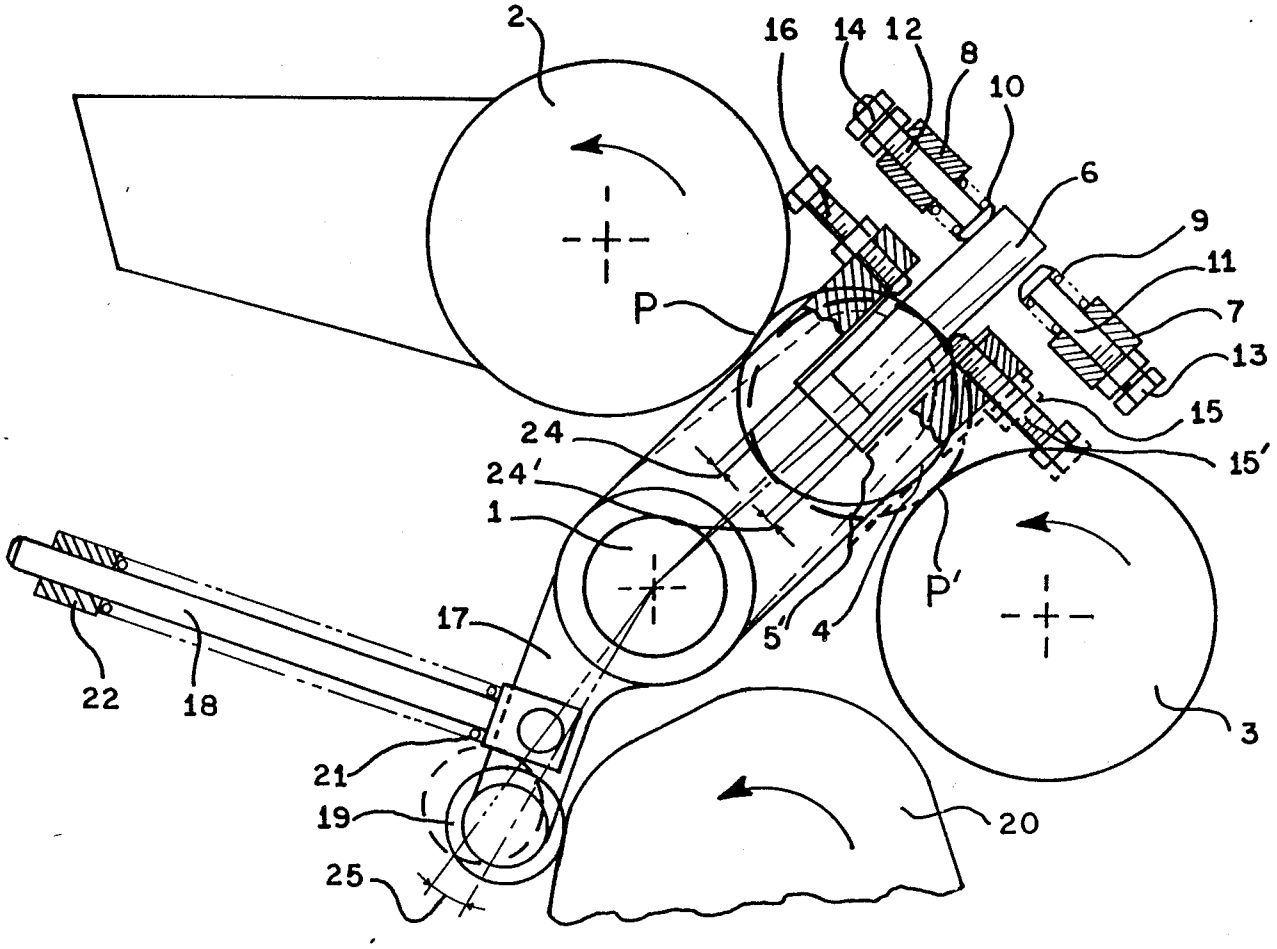
FIG. 1 is a side view of the vibrator control according to the invention.
Figure 2:
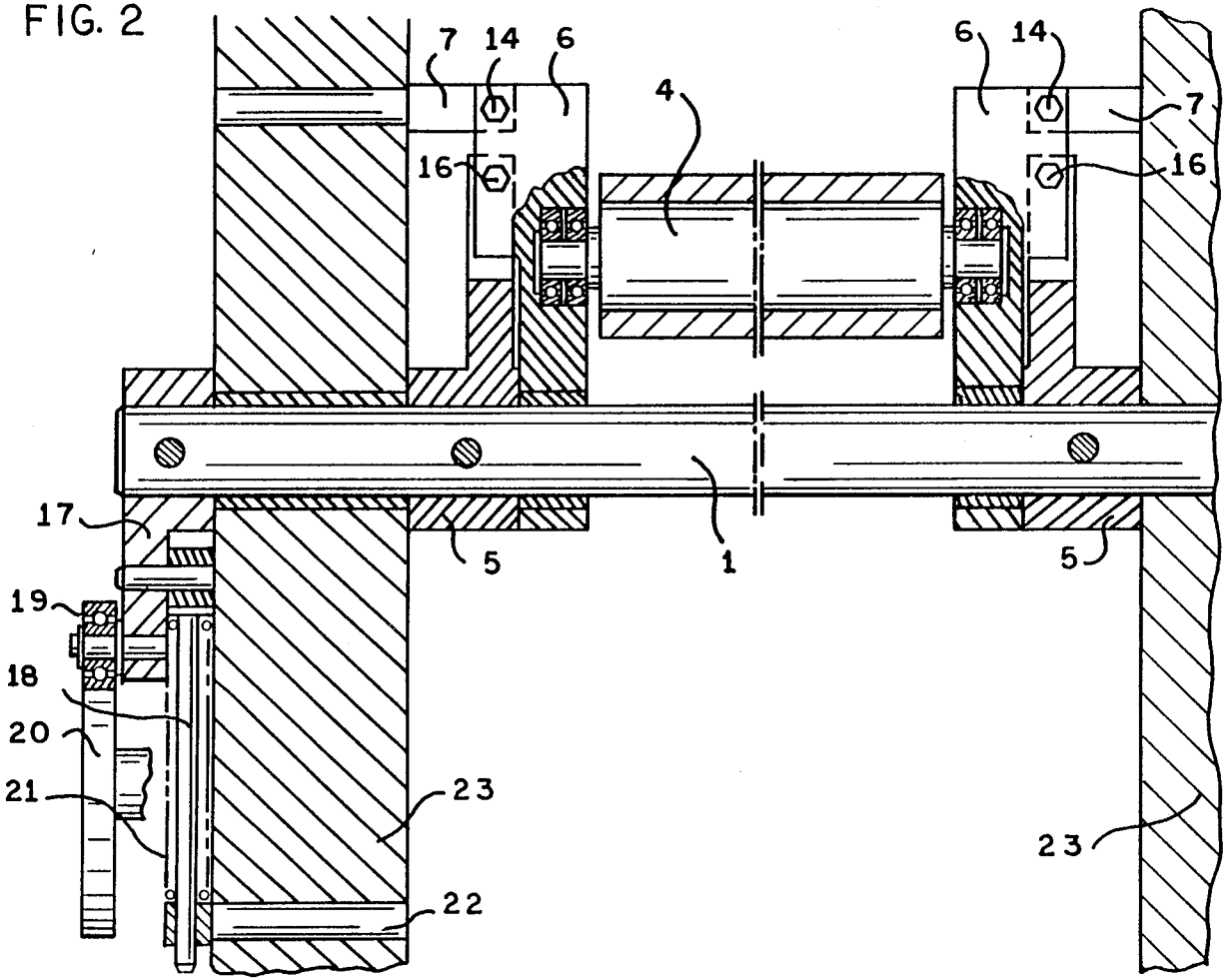
FIG. 2 is a fragmentary longitudinal section through the vibrator control.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, a portion of a printing press is shown. A ductor 2 and a distributing roller 3 are mounted in the side walls 23 of the press frame. A cam follower lever 17 is rigidly secured to a shaft 1 and one forked lever 5 is rigidly secured to the shaft 1 on the left and the right between the side walls 23. A rocking lever 6 is mounted for rotation around the shaft 1 adjacent each of the levers 5. The rocking lever arm 6 is resiliently connected to the forked lever 5, as will be described in greater detail below.

The lever 17 has its cam follower 19 pressed into engagement with the camming surface of a cam 20 through the agency of a compression spring 21 acting by way of a rod 18. Alternatively, two cams may be used when, in known manner, the second cam is to be used to adjust vibrator ink strip width. The spring 21 bears on an abutment 22 mounted in the side walls 23, thus ensuring that as the camming surface of the cam 20 rotates, the shaft 1 performs an oscillating movement of the magnitude of the pivot angle 25. The vibrator 4 is journalled in the rocking levers 6 with the interposition of rolling bearings.

To ensure that the vibrator 4 engages smoothly with the ductor 2 along a line of contact P and with the distributing roller 3 along a line of contact P', the rocking lever arm 6 is operatively connected on alternate sides to the forked lever 5 by adjusting screws 15, 16 which are disposed opposite one another in the lever 5 and which are opposed by resilient abutments 7, 9, 11, 13; 8, 10, 12, 14 disposed in the side walls 23.

The adjusting screws 15, 16 provide the basic adjustment of the vibrator 4 relatively to the ductor 2 and distributing roller 3. The vibrator 4 is adjusted relatively to the ductor 2 in a position in which the cam follower 19 is disposed on the minimum radius of the camming surface of the cam 20. The vibrator 4 is adjusted relatively to the distributing roller 3 by means of the screw 16 with the cam follower 19 positioned on the maximum radius of the cam 20. Depending on whether the vibrator 4 is contacting the ductor 2 or the distributing roller 3 there is a gap 24 between the screw 16 and the lever 6 or a gap 24' between the screw 15, which is then in a position 15', with the levers 5', 6. The gap 24' is shown merely symbolically—i.e., not accurately—in FIG. 1 to obviate the need for a further figure. Basically, the gap 24' arises with, as compared with FIG. 1, alternate engagement of the elements 9, 16 and 10, 15 respectively with the lever 6 in corresponding mirror-image fashion to the gap 24 with the approach of the ductor 2 towards the distributing roller 3. The gap 24 or 24' is largest when the rollers 2–4 have their greatest diameter, but when the rollers 2–4 become smaller as a result of wear or regrinding, the gap 24, 24' decreases correspondingly. Consequently, the vibrator control continues to function until there is no more gap 24, 24'. Only then do the circumstances known from the prior art arise.

Preferably, the gap 24, 24' between the respective screws 15, 16 and the rocking lever arm 6 should be equal to the amount of permissible wear of the rubber covering of the vibrator 4. Since the basic adjustment of the vibrator 4 relatively to the rollers 2 and 3 is always made with the cam follower 19 positioned on the minimum and maximum radius respectively of the camming surface of the cam 20, such part always produces in this zone a minimal angular speed of the lever 17, with the result that the impact speed of the vibrator 4 is minimal and, correspondingly, there is a very reduced impacting of the vibrator 4 on the rollers 2 and 3. When the cam follower 19 leaves the minimum or maximum radius as the camming surface rotates, the vibrator 4 immediately disengages from the ductor 2 and distributing roller 3. The resilient abutments 7, 9, 11, 13; 8, 10, 12, 14 boost this disengagement process. For this to operate satisfactorily the springs 9, 10 of the abutments 7, 9, 11, 13; 8, 10, 12, 14 are much weaker than the compression spring 21 associate with the cam lever 17. As described above, the abutments 7, 9, 11, 13; 8, 10, 12, 14 include resilient abutments 7, 8 mounted in the side walls 23.

The elements 7, 9, 11, 13; 8, 10, 12, 14 are brought into a one-time basic adjustment relatively to the rocking lever 6, such adjustment being carried out in the position in which the lever 17 is half-way through the cam stroke. In this position the elements 7, 9, 11, 13; 8, 10, 12, 14 are so adjusted that their pins 11, 12 just contact the rocking lever 6 by way of the spherical pin ends. This position is secured by means of locknuts 13, 14 while, as previously described, the lever 6 is engaged alternately by way of the screws 15, 16 secured to the lever 5. When the lever 5 has travelled through half the pivot angles 25—i.e., half the cam stroke—the lever 6 experiences a brief pause before the gap 24, 24' between the screws 15, 16 and the lever 6 is bridged.

The vibrator control according to the invention therefore copes with variations in vibrator diameter of $\pm 1.5$ mm and with minor differences in the diameters of the rollers 2, 3 without any alteration of the operating conditions. The pause compensates for any inaccuracies in vibrator control. The vibrator ink strips can be adjusted to be the same—i.e., reproducible—from one printing unit to another by means of appropriate known means, such as a second camming part rotatable relatively to the first camming part. Also, impacting of the vibrator 4 on the rollers 2, 3 is very much reduced.

We claim as our invention:

1. A vibrator control for inking units of printing presses, having side frames, an ink ductor roller and an ink distributing roller between which a vibrator roller can be moved into and out of engagement in oscillating fashion, the control comprising in combination, a control shaft rotatably mounted in the press side frames for oscillating movement, drive means including a rotating cam, a cam follower and a cam follower lever for oscillating the control shaft, means including a pair of rocking levers journalled on the control shaft for supporting the vibrator roller, a pair of forked levers rigidly secured to the control shaft for oscillation therewith, means including resilient abutments mounted on the press side frames and disposed on opposite sides of each rocking lever for opposing the oscillating movement thereof, each of the resilient abutments including a contact pin and means for adjusting the contact pin in order to engage the rocking lever only halfway through the operative movement produced by the drive means, means including opposed adjusting screws carried by the forked levers for operatively connecting the forked levers and the rocking levers, the adjusting screws being disposed and adjusted so that when the vibrator roller alternately contacts the ductor roller along contact line P and the spreader roller along contact line P', a gap is opened alternately between the rocking lever and the contact pin on the opposite side.

2. A vibrator control according to claim 1, characterized in that the vibrator roller is provided with a resilient covering and the adjusting screws are initially positioned relative, to the rocking lever so as to produce a gap of a width corresponding to the permissible wear thickness of the resilient covering on the vibrator roller.

* * * * *